US007725950B2

(12) United States Patent
Hinebaugh

(10) Patent No.: US 7,725,950 B2
(45) Date of Patent: Jun. 1, 2010

(54) DEVICE FOR THE HAND AND FOREARM OF THE USER

(76) Inventor: Jeffrey P. Hinebaugh, 6600 Mariemont, Cincinnati, OH (US) 45227

( * ) Notice: Subject to any disclaimer, the term of this patent is extended or adjusted under 35 U.S.C. 154(b) by 81 days.

(21) Appl. No.: 11/823,294

(22) Filed: Jun. 27, 2007

(65) Prior Publication Data

US 2009/0000003 A1 Jan. 1, 2009

(51) Int. Cl.
*A41D 13/08* (2006.01)

(52) U.S. Cl. ..... 2/16; 2/DIG. 3

(58) Field of Classification Search ..... 2/16, 2/159, 160, 161.1, 161.6, 161.5
See application file for complete search history.

(56) References Cited

U.S. PATENT DOCUMENTS

| | | | | | |
|---|---|---|---|---|---|
| 61,841 | A | * | 2/1867 | Lewis | 68/220 |
| 1,253,260 | A | * | 1/1918 | Levinson | 2/462 |
| 1,270,697 | A | * | 6/1918 | Chapman | 2/162 |
| 1,627,382 | A | * | 5/1927 | Golomb | 2/18 |
| 2,074,390 | A | * | 3/1937 | Green | 2/16 |
| 2,082,574 | A | * | 6/1937 | Handley | 2/16 |
| 2,314,922 | A | * | 3/1943 | Chanut | 2/159 |
| 2,432,325 | A | * | 12/1947 | McDougall | 2/160 |
| 2,493,370 | A | * | 1/1950 | Smith | 2/94 |
| 3,000,378 | A | * | 9/1961 | Zieman | 602/62 |
| 3,217,332 | A | * | 11/1965 | Gross | 2/16 |
| 3,991,420 | A | * | 11/1976 | Savarino | 2/462 |
| 4,011,596 | A | * | 3/1977 | Chang | 2/16 |
| 4,133,624 | A | * | 1/1979 | Heavner et al. | 425/275 |
| 4,287,608 | A | * | 9/1981 | Meyer | 2/16 |
| 4,306,315 | A | * | 12/1981 | Castiglia | 2/22 |
| 4,330,120 | A | * | 5/1982 | Netti | 482/105 |
| 4,512,037 | A | * | 4/1985 | Vacanti | 2/22 |
| 4,556,992 | A | * | 12/1985 | Drury | 2/20 |
| 4,599,747 | A | * | 7/1986 | Robinson | 2/461 |
| D290,766 | S | * | 7/1987 | Pierce, Jr. | D29/120.1 |
| 4,707,861 | A | * | 11/1987 | Lavoie et al. | 2/16 |
| 4,756,026 | A | * | 7/1988 | Pierce, Jr. | 2/16 |
| 4,899,763 | A | | 2/1990 | Sebastian et al. | |
| 4,967,419 | A | * | 11/1990 | Elliott | 2/16 |
| 5,070,541 | A | * | 12/1991 | Goss | 2/16 |
| 5,452,478 | A | * | 9/1995 | Rombach et al. | 2/161.6 |
| 5,594,954 | A | * | 1/1997 | Huang | 2/24 |
| D393,138 | S | * | 4/1998 | Frey | D2/610 |
| 5,784,715 | A | * | 7/1998 | Buchanan | 2/22 |
| 5,864,886 | A | * | 2/1999 | Gregory et al. | 2/170 |
| 5,983,391 | A | * | 11/1999 | Palmer et al. | 2/16 |

(Continued)

*Primary Examiner*—Katherine Moran
*Assistant Examiner*—Richale L Quinn
(74) *Attorney, Agent, or Firm*—Dinsmore & Shohl LLP

(57) ABSTRACT

In one embodiment, a device for the hand and forearm of a user may include a glove portion and a sleeve. The sleeve is integrally attached to the glove portion and includes an elastic portion and a flexible support portion. The elastic portion is configured to contact a substantial portion of a forearm of a user and the flexible support portion is configured to minimize impact to the forearm. In another embodiment, a device for the forearm of a user may include a sleeve. The sleeve includes an elastic portion and a flexible support portion. The elastic portion is configured to contact a substantial portion of a forearm of a user and the flexible support portion is configured to minimize impact to the forearm and enhance catching of a ball. The elastic portion being configured to interact with a glove of the user.

12 Claims, 5 Drawing Sheets

U.S. PATENT DOCUMENTS 6,013,044 A * 1/2000 Estwanik ..... 602/64
6,092,235 A * 7/2000 Santa Cruz et al. ..... 2/16
6,094,743 A * 8/2000 Delgado ..... 2/16
6,098,208 A * 8/2000 Cordon ..... 2/455
6,192,519 B1 * 2/2001 Coalter ..... 2/16
D442,765 S * 5/2001 Newman ..... D2/610
6,691,315 B1 * 2/2004 Clarke et al. ..... 2/20
6,711,747 B2 * 3/2004 Carlin ..... 2/161.1
6,880,172 B2 * 4/2005 Quintero ..... 2/16
7,055,178 B2 * 6/2006 Gottlieb ..... 2/161.1
7,171,697 B2 * 2/2007 Vito et al. ..... 2/161.1
D548,892 S * 8/2007 Wilson et al. ..... D29/120.1
7,389,544 B1 * 6/2008 Biggerstaff ..... 2/16
2003/0196247 A1 * 10/2003 Hellriegel ..... 2/159
2004/0226075 A1 * 11/2004 Marchal ..... 2/160
2005/0268365 A1 * 12/2005 Sandebeck ..... 2/16
2007/0022512 A1 * 2/2007 Coulter et al. ..... 2/161.1
2007/0204373 A1 * 9/2007 Loyens et al. ..... 2/16

* cited by examiner

DEVICE FOR THE HAND AND FOREARM OF THE USER

TECHNICAL FIELD

The present invention is directed to devices configured to both minimize impact to the hand and forearm of a user and, in particular, an athlete and to provide for enhanced catching. The device can include a sleeve portion and, in some additional embodiments, a glove portion.

BACKGROUND OF THE INVENTION

It is known that many athletes, particularly goalies in soccer and wide-receivers in football, prefer to utilize gloves. Indeed, gloves allow such athletes to optimize catching of the ball and prevent injury to the hand by dampening the ball's impact. In particular, with regard to goalies in soccer, the use of a foam-like and/or other material on the face of goalie gloves has been known for years to increase the ability of goalkeepers to catch and control the ball. In fact, goalie gloves have developed over the years to increase the surface area of the foam-like material while maintaining the flexibility and feel needed for a goalkeeper to control and distribute the ball while in his possession.

In catching certain types of low shots, short hops and ground balls, the technique employed by many goalkeepers is to scoop the ball with their hands and the underside of their forearms. When a hard shot is taken, or when the ball or goalkeepers forearms are wet or moist, balls may get by the goalkeeper by going through his forearms. The material used in most long sleeve goalkeeper jerseys is generally slick and also allows the ball to slide through a goalkeepers forearms. A few jerseys do use a small amount of foam-like material on the sleeve, but the position of the material and the amount used is generally not effective to provide a material benefit to keep balls from going through a goalkeepers forearms.

In addition, during break-away and one v. one situations, many goalkeepers use the technique of coming off of their goal line toward the oncoming player in order to cut down his angle on goal. In attempting to gain possession of the ball and/or to stop shots in these situations, many goalkeepers will extend their body horizontally across the ground toward the oncoming player, creating as much area to stop a shot as possible. In many situations, the shot taken by the offensive player will strike the goalkeeper on the underside of the forearms with great force. In other situations the offensive player will attempt to power the ball through the goalkeeper, striking the underside of the goalkeepers forearms with the ball and his foot. Again, in many cases the ball will slide through the goalkeepers arms due, in some cases, to the buildup of sweat and moisture on the goalkeeper's arms.

Additionally, it is also known that in many types of competitive sports, such as soccer and football, the forearm area is at risk to injury, particularly from impact forces caused by contact with an opponent, ground, and/or ball. As such, to prevent bodily injury to the user, it is often desirable to utilize a forearm protector, whether added directly to the forearm or to the jersey sleeve, to minimize the magnitude of force from any impact to the forearm. Unfortunately, however, in addition to providing the desired impact protection, known forearm protectors are also often bulky, frequently slide down the user's forearm and restrict the athletes' range of motion.

Accordingly, there remains a need for a device for a user and, particularly, an athlete, that increasing the ability of a goalkeeper to catch low shots, short hops and ground balls and provide increased catching and blocking ability for goalkeepers in break-away and one v. one situations by inhibiting balls from slipping through the athlete's arms. Additionally, there also remains a need for a device that facilitates the combination of gloves and forearm protectors, is less bulky, is better secured to the user's forearm and minimizes restriction upon the athletes' range of motion.

SUMMARY OF THE INVENTION

In accordance with one embodiment of the present invention, a device for the hand and forearm of a user may include a glove portion and a sleeve. The sleeve is integrally attached to the glove portion and includes an elastic portion and a flexible support portion. The elastic portion is configured to contact a substantial portion of a forearm of a user and the flexible support portion is configured to minimize impact to the forearm and enhance catching of a ball.

In accordance with another embodiment of the present invention, a device for the forearm of a user may include a sleeve. The sleeve including an elastic portion and a flexible support portion. The elastic portion is configured to contact a substantial portion of a forearm of a user and the flexible support portion is configured to minimize impact to the forearm and enhance catching of a ball. The elastic portion being configured to interact with a glove of the user.

In accordance with yet another embodiment of the present invention, a device for the hand and forearm of a user may include a glove portion and a sleeve. The sleeve is integrally attached to the glove portion and includes an elastic portion, a flexible support portion and a securement portion. The elastic portion is comprised of nylon and is configured to contact a substantial portion of a forearm of a user. The flexible support portion is comprised of a soft foam and is configured to minimize impact to the forearm and enhance catching of a ball. The securement portion is configured to secure the sleeve to the forearm of the user.

The devices described herein are advantageous for increasing the ability of a goalkeeper to catch low shots, short hops and ground balls and provide increased catching and blocking ability for goalkeepers in break-away and one v. one situations by inhibiting balls from slipping through the athletes arms. Additionally, the devices described herein are also advantageous for facilitating the combination of gloves and forearm protectors, is less bulky, is better secured to the user's forearm, minimizes restriction upon the athletes' range of motion, and enhances catching of a ball. Still other embodiments and advantages of the present invention will become apparent to those skilled in the art from the following descriptions wherein there are shown and described alternative embodiments of this invention for illustrative purposes. As will be realized, the invention is capable of other different aspects and embodiments all without departing from the scope of the invention. Accordingly, the drawings and description should be regarded as illustrative and exemplary in nature only and not as restrictive of the claimed invention.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

Figure 1:
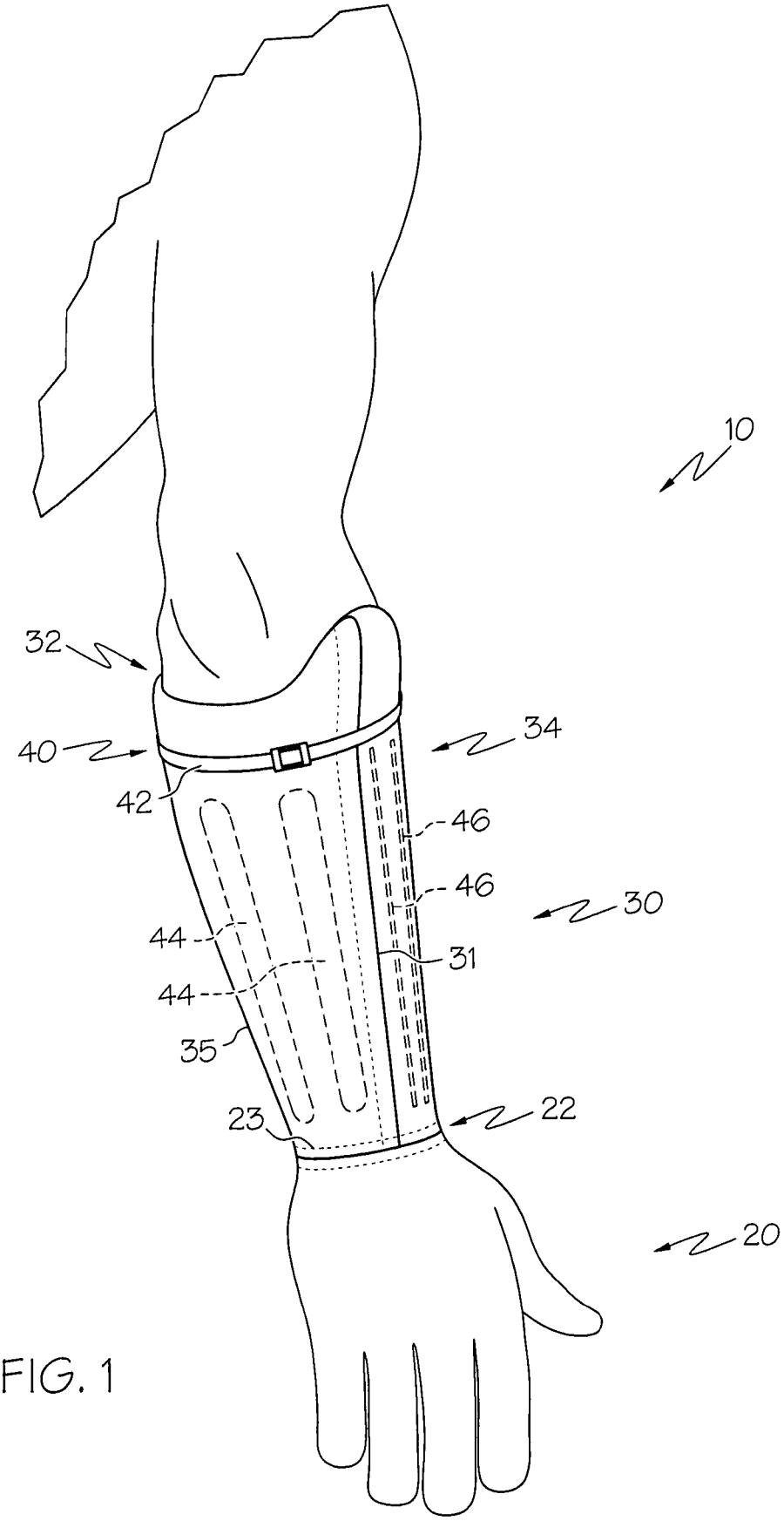
FIG. 1 is a side perspective view depicting a device having a glove portion and sleeve in accordance with one embodiment of the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF EMBODIMENTS

The present invention and its operation are hereinafter described in detail in connection with the views and examples of FIGS. 1-6, wherein like numbers indicate the same or corresponding elements throughout the views. The present invention is directed to devices and, specifically, to devices configured to both minimize impact to the hand and forearm of a user and, in particular, an athlete and to provide for enhanced catching.

Figure 2:
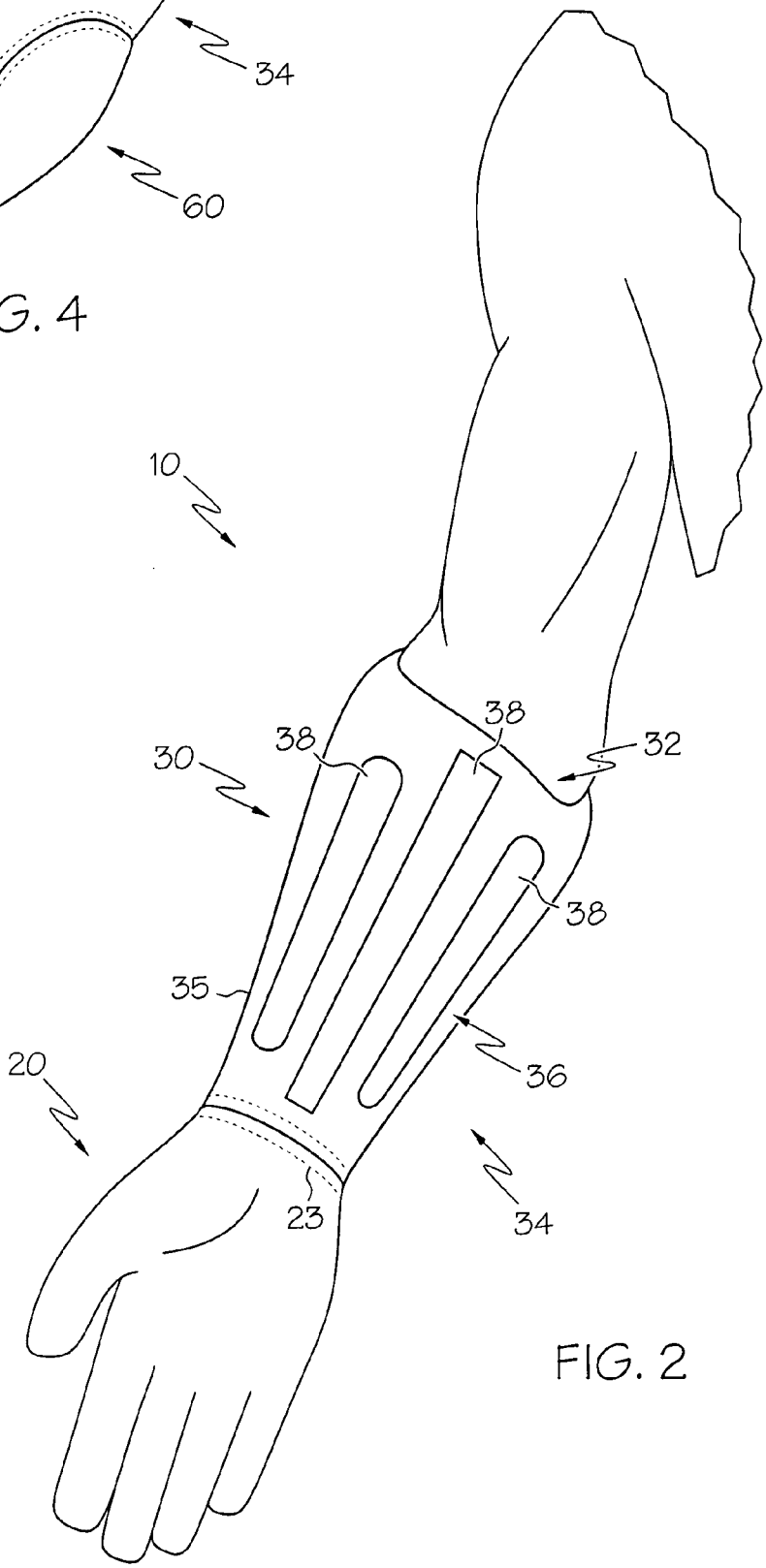
FIG. 2 is a backside perspective view depicting the device of FIG. 1.

Generally, as illustrated in FIGS. 1 and 2, the device 10 for the hand and forearm of a user may include a glove portion 20 and a sleeve 30. It will be appreciated that the glove portion 20 in accordance with the present invention is well known in the art. In this regard, although certain component parts (e.g., the wrist strap 22 and interior surface, not shown) are described in detail further herein, it is only exemplary in nature and any person of ordinary skill in the art might also include additional components and parts, as desired. It will be further appreciated that the user may secure the device 10 to their arm in any manner, as desired. For example, upon putting on the glove portion 20, the sleeve 30 may include a hook and loop/latch fastener (e.g., a VELCRO™ strip), zipper, or buttons extending up the forearm, the user may roll the sleeve 30 up their forearm, or may include combinations thereof. However, in particular, in the embodiments described in further detail herein, the sleeve includes a VELCRO™ strip 31 extending up the exterior of the forearm, as best depicted in FIG. 1.

A device 10 in accordance with the present invention can be formed from any of a variety of alternative materials known in the art. For example, the sleeve 30 may include an elastic portion 34 formed of an elastic material, such as nylon, neoprene, polyester, rayon, cotton, and blends and/or combinations thereof. Generally, however, it will be appreciated that the elastic material be sufficiently sturdy to withstand athletic use, yet sufficiently thin to allow the athlete to detect contact with the ball. For example, in one embodiment, the elastic material may have a thickness of about three millimeters so that a desired balance of weight, flexibility, elasticity, resiliency, durability and/or breath-ability is achieved. In particular, in the embodiments described in further detail herein, the elastic portion of the device may be formed substantially of a nylon material. Advantageously, it will be appreciated that a sleeve 30 formed substantially of these materials will provide a less bulky piece of equipment that minimizes restriction upon the athletes' range of motion.

Additionally, the sleeve 30 may also include a flexible support portion 36 that may be formed, for example, of a rubber, soft foam, plastic and blends and/or combinations thereof. In particular, in the embodiments described in further detail herein, the flexible support portion may be formed substantially of a soft foam. Generally, however, it will be appreciated that the flexible support portion may be formed of any material that may both minimizes impact to the forearm and optimizes catching of a ball, as desired. Within the context of the present specification, the term "optimizes catching" describes a flexible support portion 36 which provides a slightly higher coefficient of friction than the rest of the sleeve 30. Advantageously, it will be appreciated that a flexible support portion 36 formed substantially of materials that optimize catching will provide a certain degree of "stickiness" or "tackiness" that may assist an athlete in catching and/or controlling a ball. It will also be appreciated that a flexible support portion 36 formed substantially of materials that optimize catching may also inhibit a ball from slipping through an athlete's arms.

Figure 4:
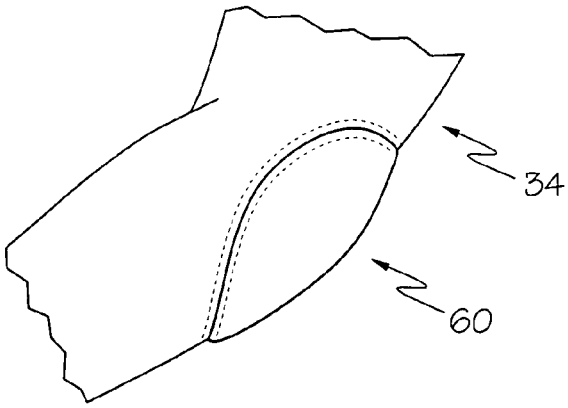
FIG. 4 is a rear perspective view depicting a elbow insert in accordance with certain embodiments of the present invention.

Referring to FIGS. 1 and 2, the sleeve 30 may be integrally attached to the glove portion 20. Within the context of the present specification, the term "integrally attached" describes a sleeve which is secured to the glove portion sufficient to withstand the rigors of athletic competition without detachment. For example, the sleeve 30 may be integrally attached to the glove portion 20 by stitching, buttons and/or clips. In one specific embodiment, as best shown in FIGS. 1-2 and 4, the sleeve 30 is integrally to the glove portion 20 by stitching 23. It will be appreciated, however, that the sleeve 30 may be integrally attached to the glove portion 20 by any material and/or device as known in the art.

As illustrated in FIGS. 1 and 2, the sleeve 30 may include an elastic portion 34 and a flexible support portion 36. In one embodiment, the elastic portion 34 is configured to contact a substantial portion of a forearm of the user. However, it will be appreciated that an elastic portion in accordance with the present invention may be sized and configured to contact various portions of the forearm and/or arm of the user, as desired. In another embodiment, the flexible support portion 36 may be positioned substantially on an exterior surface of the elastic portion 35. It will be further appreciated that the flexible support portion may also be disposed within or on an interior surface (not shown) of the elastic portion 35, as desired.

Figure 3:
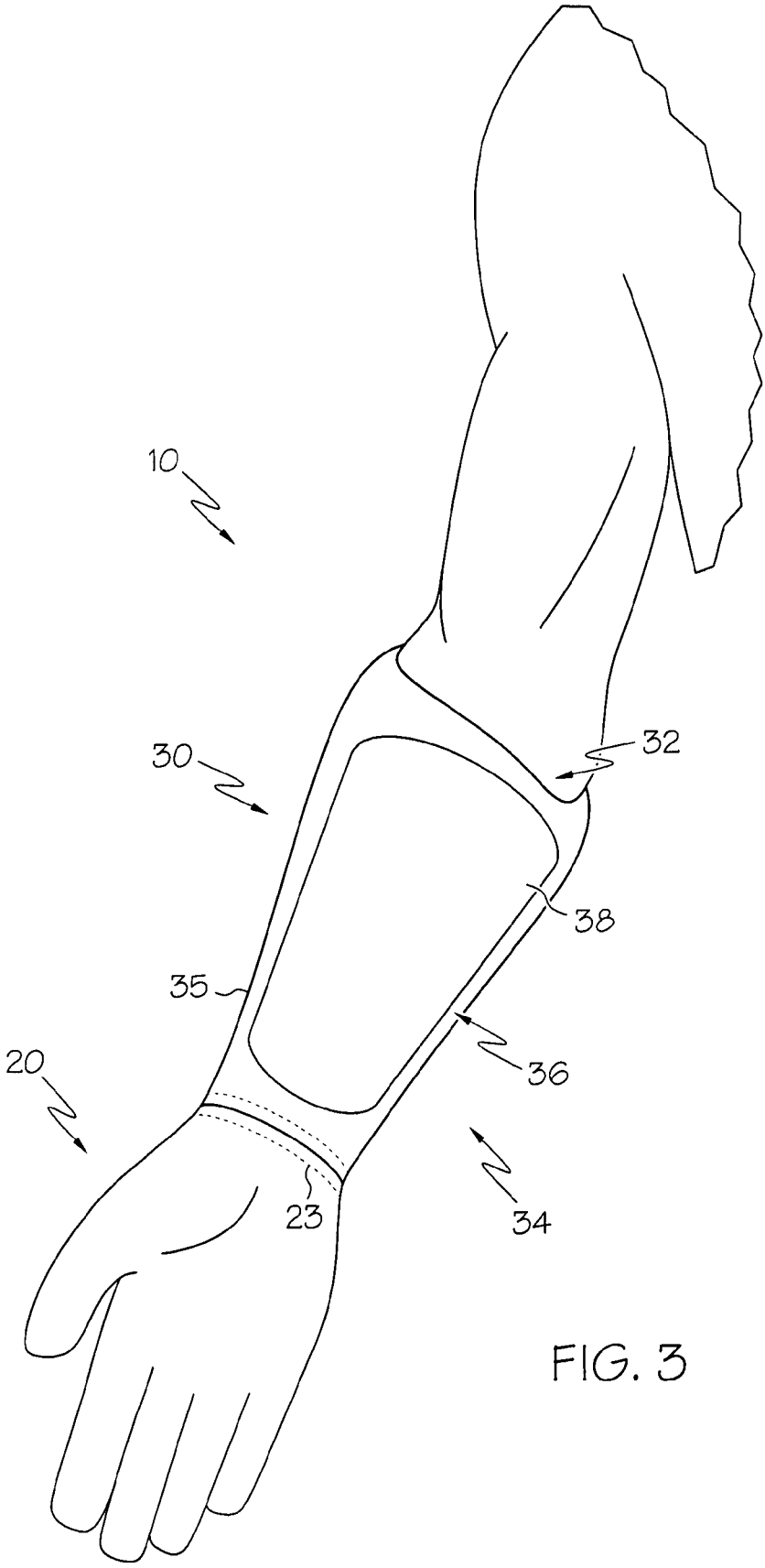
FIG. 3 is a backside perspective view depicting a glove portion and sleeve in accordance with one embodiment of the present invention.

As illustrated in FIGS. 2-3, the flexible support portion 36 may comprise a support strip 38. Additionally, in one specific embodiment, as illustrated in FIG. 2, the flexible support portion 36 may comprise a plurality of support strips 38. In another specific embodiment, the support strip 38 may extend down the forearm and may be substantially rectangular in shape. Additionally, in another specific embodiment, the support strips may be dimensioned such that they are no more than about 1 inch apart. Generally, however, it will be appreciated that a support strip 38 in accordance with the present invention may be sized and configured, as desired. In another specific embodiment, as illustrated in FIGS. 2-3, the flexible support portion 36 is configured to minimize impact to an inner forearm of the user. However, it will be appreciated that the flexible support portion 36 may minimize the impact to an exterior forearm, substantially the entire forearm, or any other portion of the forearm and/or arm of the user, as desired. Additionally, in yet another specific embodiment, the flexible support portion 36 may be configured to enhance catching of a ball and/or may also inhibit a ball from slipping through an athlete's arms. Advantageously, it will be appreciated that a flexible support portion 36 formed of support strips 38 may provide a goalkeeper, in soccer, the enhanced ability to "bowl" or "whip" the ball to his or her teammates with a greater degree of control and accuracy.

As illustrated in FIG. 1, the sleeve 30 may include a securement portion 40 configured to secure the sleeve 30 to the forearm of the user. It will be understood, however, that in the context of the present specification, the term "secure" describes a securement portion that substantially prevents the sleeve 30 from slipping down the forearm of the user. In one specific embodiment, the securement portion 40 may include an elastic band 42, as best illustrated in FIG. 1, that is positioned at an upper portion of the sleeve 32. In another specific embodiment, the securement portion 40 includes air bladders 44 that extend down the length of the forearm. In yet another specific embodiment, the securement portion 40 includes ribs 46 that extend down the length of the forearm. Generally, however, it will be appreciated, that the securement portion 40 may be positioned and configured, as desired.

In one embodiment, as illustrated in FIG. 3 and FIG. 4, the sleeve 30 may include an elbow insert 60 configured to minimize impact to an elbow of the user. Generally, it will be appreciated, that the elbow insert 60 may formed of the same materials as discussed above with regard to the flexible support portion 36 and may be shaped and configured, as desired. However, as illustrated in the embodiment depicted in FIG. 3, the flexible support portion 36 may be formed substantially of a soft foam and may be secured to an exterior portion of the sleeve 30 by stitching.

Figure 5:
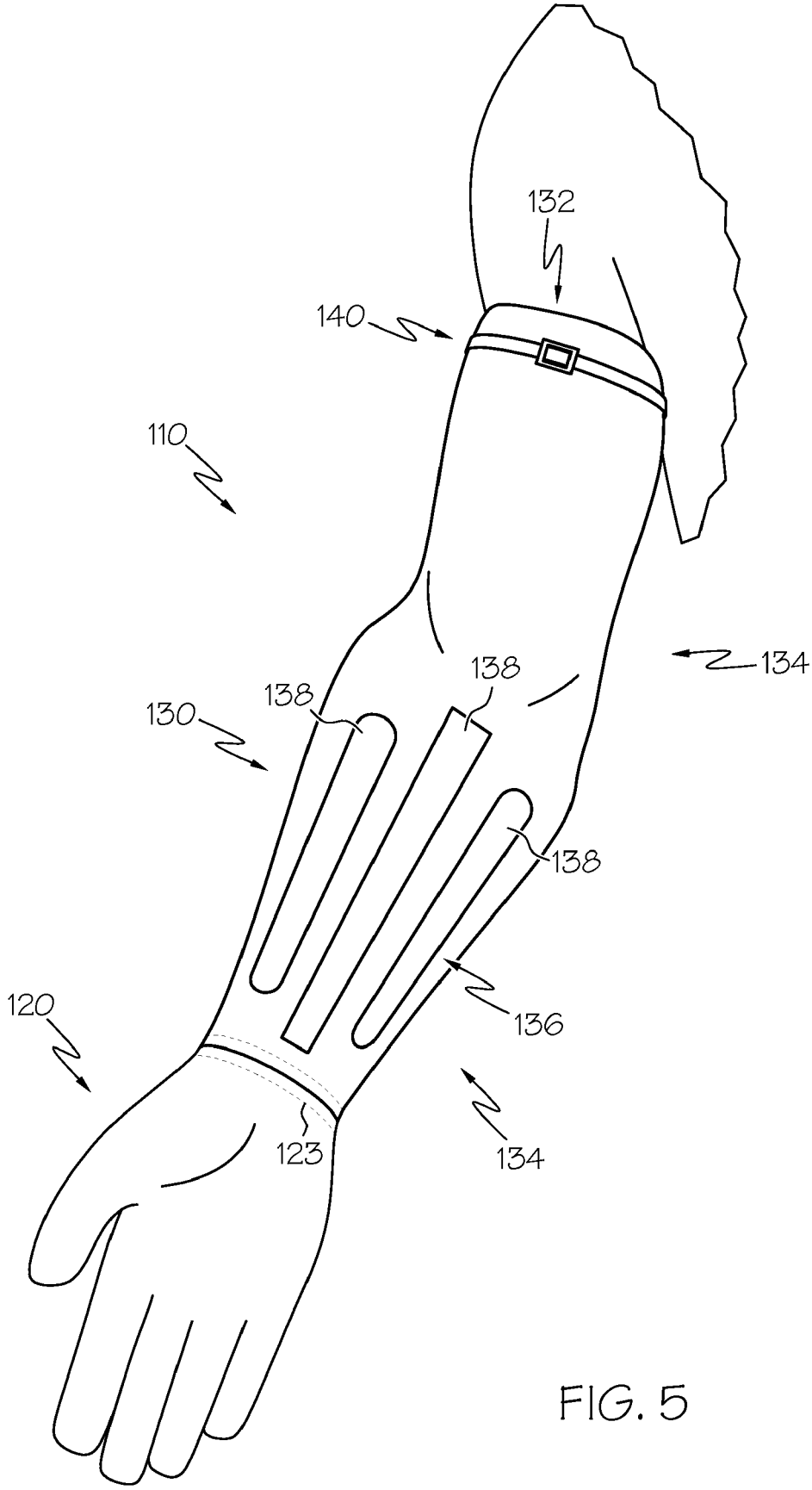
FIG. 5 is a side perspective view depicting a device having a sleeve configured to be secured to the bicep of the user in accordance with certain embodiment of the present invention.

In yet another embodiment, as illustrated in FIG. 5, the device 110 comprises a glove portion 120 connected to a sleeve 130 by stitching 123. The sleeve may comprise a flexible support portion 136 formed of support strips 138. The elastic portion 134 of the sleeve 130 may be configured to contact a substantial portion of a bicep of the user. It will be appreciated that the features and embodiments discussed above with regard to the elastic portion 34 and sleeve 30 may apply equally here, as desired. However, in addition, the sleeve 130 may also include a securement portion 140 positioned at an upper portion of the sleeve 132 and configured to secure the sleeve to the bicep of the user.

Figure 6:
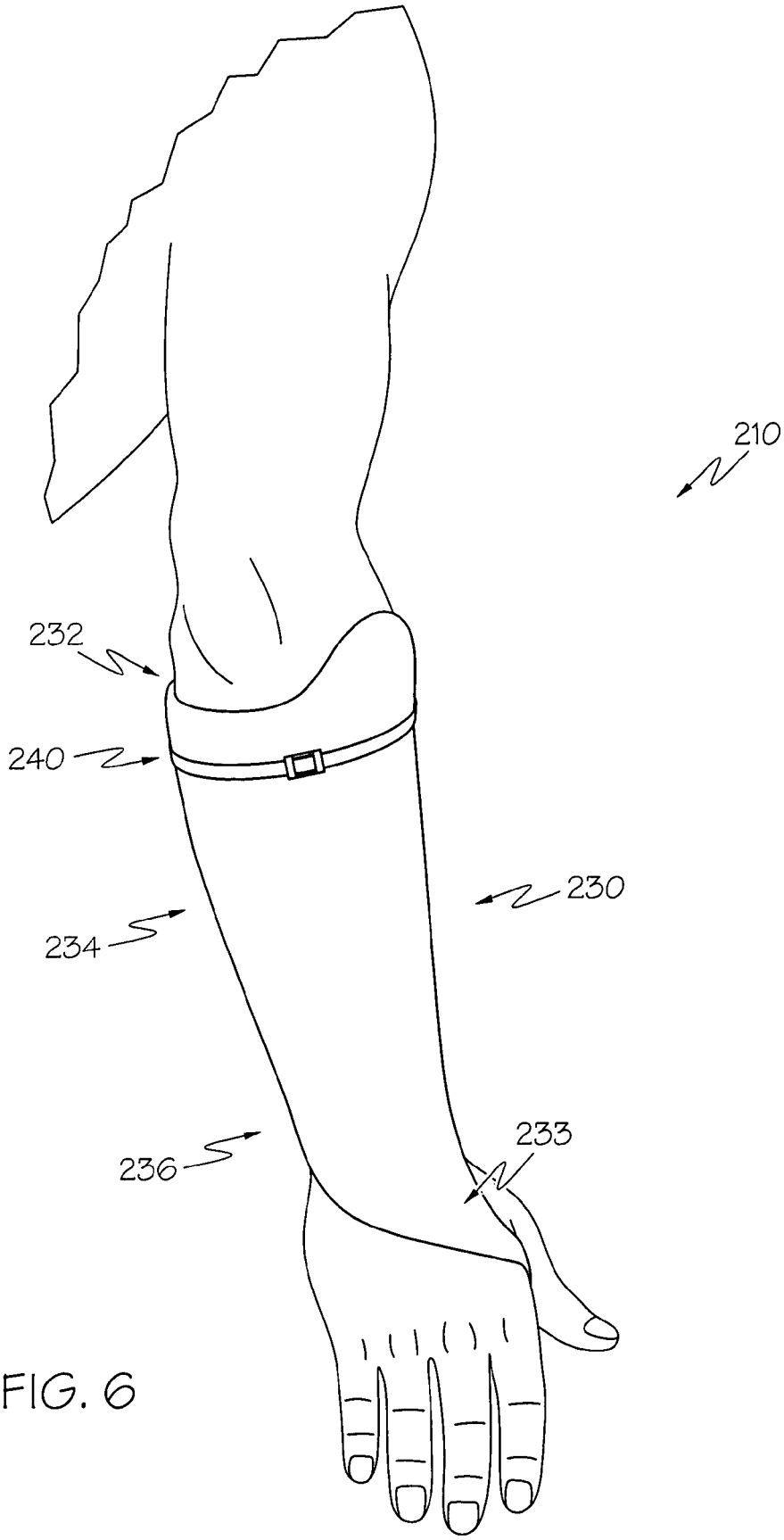
FIG. 6 is a side perspective view depicting a device having a hand portion in accordance with certain embodiments of the present invention.

Another embodiment of a device 210 for the forearm of a user is illustrated in FIG. 6. In this embodiment, a sleeve 230 with an upper portion of the sleeve 232 and a securement portion 240 may also include an elastic portion 234 configured to interact with a glove of the user (not shown) and a flexible support portion 236. It will be understood, however, that in the context of the present specification, the term "interact" describes a elastic portion that abuts the glove of the user, but does not substantially attach to the glove. Generally, it will be appreciated that the features and embodiments discussed above with regard to the sleeve 30, elastic portion 34 and flexible support portion 36 may apply equally here, as desired. However, in addition, in this embodiment the elastic portion 234 includes a hand portion 233 configured to secure the elastic portion to the hand and contact an interior surface (not shown) of the glove of the user.

The foregoing description of embodiments and examples of the invention has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A device for the hand and forearm of a user, comprising:

a glove portion; and a sleeve integrally attached to the glove portion and including an elastic portion and a flexible support portion comprising a soft foam, wherein the elastic portion is configured to contact a substantial portion of a forearm of a user and the flexible support portion is configured to minimize impact to the forearm and comprises a tacky outer surface to enhance catching of a ball, and wherein the sleeve comprises a securement portion configured to secure the sleeve to the forearm of the user, wherein the securement portion comprises air bladders that extend down a length of the forearm.

2. The device of claim 1, wherein the flexible support portion comprises a plurality of support strips dimensioned no more than about 1 inch apart.

3. The device of claim 1, wherein the elastic portion is comprised of nylon.

4. The device of claim 1, wherein the flexible support portion is positioned substantially on an exterior surface of the elastic portion.

5. The device of claim 1, wherein the elastic portion is configured to contact a substantial portion of a bicep of the user.

6. The device of claim 1, wherein the flexible support portion is configured to minimize impact to an inner forearm of the user.

7. The device of claim 1, wherein the sleeve comprises a elbow insert configured to minimize impact to an elbow of the user.

8. A device for the forearm of a user, comprising:

a sleeve including an elastic portion and a flexible support portion, wherein the elastic portion is configured to contact a substantial portion of a forearm of a user and the flexible support portion comprises a single continuous flexible support strip having a tacky outer surface to enhance catching of a ball, and comprising a soft foam operable to partially absorb a force from the ball to minimize impact to the forearm, the elastic portion being configured to interact with a glove of the user, and wherein the sleeve comprises a securement portion configured to secure the sleeve to the forearm of the user, wherein the securement portion comprises air bladders that extend down a length of the forearm.

9. The device of claim 8, wherein the elastic portion comprises a hand portion configured to contact an interior surface of the glove of the user.

10. The device of claim 9, wherein the elastic portion is comprised of nylon.

11. The device of claim 8, wherein the single continuous flexible support strip is disposed about an inner forearm of the user to minimize impact to the inner forearm.

12. A device for the hand and forearm of a user, comprising:

a glove portion; and a sleeve integrally attached to the glove portion and including an elastic portion, a flexible support portion and a securement portion, wherein the elastic portion is comprised of nylon and is configured to contact a substantial portion of a forearm of a user, the flexible support portion comprises a plurality of support strips disposed about the forearm of the user and running in a direction substantially parallel with a length of the forearm of the user, the plurality of support strips each being individually surrounded on all sides by the elastic portion and comprising soft foam having a tacky outer surface to enhance catching of a ball and to partially absorb a force from the ball to minimize impact to the forearm, and the securement portion is configured to secure the sleeve to the forearm of the user, wherein the securement portion comprises air bladders that extend down a length of the forearm.

* * * * *